US005865712A

United States Patent [19]

Chang

[11] Patent Number: 5,865,712

[45] Date of Patent: Feb. 2, 1999

[54] WALKING EXERCISER

[76] Inventor: Major Chang, 1F, No. 764, Chung Shan S. Rd., Yang Mei Town, Tao Yuan Hsien, Taiwan

[21] Appl. No.: 8,295

[22] Filed: Jan. 16, 1998

[51] Int. Cl.[6] ..... A63B 69/16; A63B 22/04

[52] U.S. Cl. ..... 482/57; 482/52

[58] Field of Search ..... 482/51, 52, 53, 482/57, 58, 59, 62, 70

[56] References Cited

U.S. PATENT DOCUMENTS 5,290,211 3/1994 Stearns ..... 482/53
5,628,709 5/1997 Chen ..... 482/53
5,676,623 10/1997 Yu ..... 482/53
5,766,113 6/1998 Rodgers ..... 482/70

*Primary Examiner*—Stephen R. Crow
*Attorney, Agent, or Firm*—Rosenberg, Klein & Bilker

[57] ABSTRACT

A walking exerciser which includes two pedal frames respectively supported on two cranks at two opposite sides of a driving wheel and adapted for turning the driving wheel by legs, two rockers, and two curved coupling rods having a respective front end respectively pivoted to the rockers and a respective rear end respectively pivoted to the cranks and moved with the cranks along a respective longitudinal sliding slot on each pedal frame.

12 Claims, 9 Drawing Sheets

WALKING EXERCISER

BACKGROUND OF THE INVENTION

The present invention relates to walking exercisers, and more particularly to a simple structure of walking exerciser which keeps the pedal frames in horizontal when the pedal frames are moved with the legs along an oval track.

This present invention provides an improved structure of U.S. patent application Ser. No. 08/944,587. FIGS. 1A and 1B show a step exercising apparatus according to U.S. patent application Ser. No. 08/736,006. A step exerciser in accordance with this present invention comprises a main shaft 1 having a downwardly vertically extended front rod 11 and a downwardly vertically extended rear rod 12 at its two opposite ends, a transverse rear bar 2 fixedly connected to the downwardly vertically extended rear rod 12 of the main shaft 1 for supporting it on the ground, a horizontally disposed barrel 13 fixedly connected to the downwardly vertically extended front rod 11 of the main shaft 1 for supporting it on the ground, two horizontal tubes 21 connected to the horizontally disposed barrel 13 at two opposite sides by an axle 14 and two end caps 3, and two oscillating bars 4 turned about the axle 14 and connected between the barrel 13 of the main shaft 1 and the horizontal tubes 21. Each oscillating bar 4 has a bottom end terminating in a horizontal barrel 41 sleeved on the axle 14 and connected between the barrel 13 of the main shaft 1 and one horizontal tube 21 by ring caps 31, and a top end terminating in a pair of upwardly extended parallel lugs 42. Two front links 5 are provided having a respective front end respectively pivoted to the oscillating bars 4 below the upwardly extended parallel lugs 42. Two rear links 51 are provided having a respective notched front end 52 respectively pivoted to the rear ends of the front links 5 remote from the oscillating bars 4. Two actuating bars 9 are provided having a respective pair of downwardly extended parallel lugs 92 at the rear end respectively pivoted to the rear ends of the rear links 51 remote from the front links 5, and a respective pair of forwardly extended parallel lugs 91 respectively pivoted to the upwardly extended parallel lugs 42 of the oscillating bars 4. The main shaft 1 further comprises a front wheel slot 15 and a rear wheel slot 16. A driving wheel 16 is revolvably supported in the rear wheel slot 16. A fly wheel 8 is revolvably supported in the front wheel slot 15 and coupled to the driving wheel 16 by a transmission belt 17. Two cranks 6 are bilaterally coupled between the driving wheel 16 and the rear links 51.

Two foot plates B are respectively and fixedly mounted on the actuating bars 9, two handlebars C are provided having a respective bottom end respectively pivoted to the upwardly extended parallel lugs 42 of the oscillating bars 4 and the forwardly extended parallel lugs 91 of the actuating bars 9; a step counter A is mounted on the main shaft 1 at the front side between the handlebars 9. The bottom end of each handlebar C is preferably made having a friction ring disposed in contact with the front end of the corresponding actuating bar 9 so that the handlebars C can be turned to impart a resisting force to the actuating bars 9 when the user pedals the foot plates B.

When the user steps on the foot plates B alternatively, the rear links 51 are alternatively forced by the actuating bars 9 to turn the driving wheel 7, causing the flywheel 8 to be turned by the transmission belt 17. Because the rear links 51 are respectively pivoted to the front links 5 and the front links 5 are respectively pivoted to the oscillating bars 4, the actuating bars 9 are forced to move along an oval track when the foot plates B are pedaled.

The structure of invention of U.S. patent application Ser. No. 08/736,006 is complicated. The foot plates are inclining with truning buring the action. It doesn't have choice and fun. This structure of step exercising apparatus is functional. However, this structure of step exercising apparatus cannot help the user to simulate actual walking exercises because the foot pedals of the step exercising apparatus are tilted up and down when pedaling.

SUMMARY OF THE INVENTION

It is the main object of the present invention to provide a walking exerciser which enables to move the usre's the legs along an oval track, so as to simulate actual walking exercises. It is another object of the present invention to provide a walking exerciser which keeps the pedal frames in horizontal when the pedal frames are moved with the legs along an oval track. It is still another object of the present invention to provide a walking exerciser which is simple and inexpensive to manufacture. According to one aspect of the present invention, the walking exerciser comprises two pedal frames respectively supported on two cranks at two opposite sides of a driving wheel and adapted to turning the driving wheel by legs, two rockers respectively pivoted to the front side of the base frame thereof, and two curved coupling rods having a respective front end respectively pivoted to the top ends of the rockers remote from the base frame and a respective rear end respectively pivoted to the cranks and moved with the cranks along a respective longitudinal sliding slot on each pedal frame. According to another aspect of the present invention, two handlebars are respectively pivoted to the top ends of the rockers for turning by hand.

DETAILED DESCRIPTION OF THE PREFERRED EMBODIMENTS

Figure 1A:
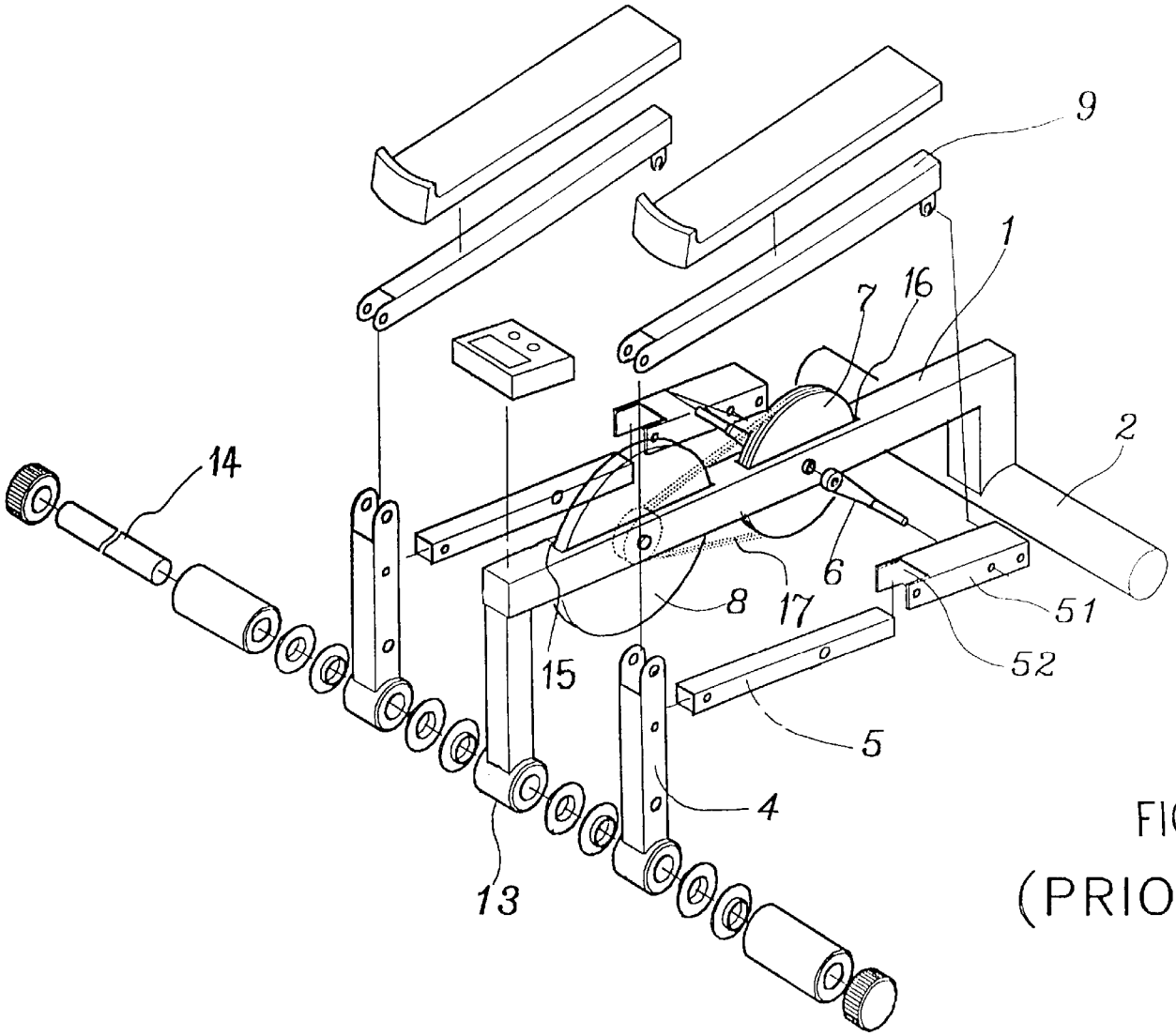
FIG.1A (PRIOR ART)
FIG. 1A is an exploded view of an exercising apparatus according to U.S. patent application Ser. No. 08/736,006.
Figure 1B:
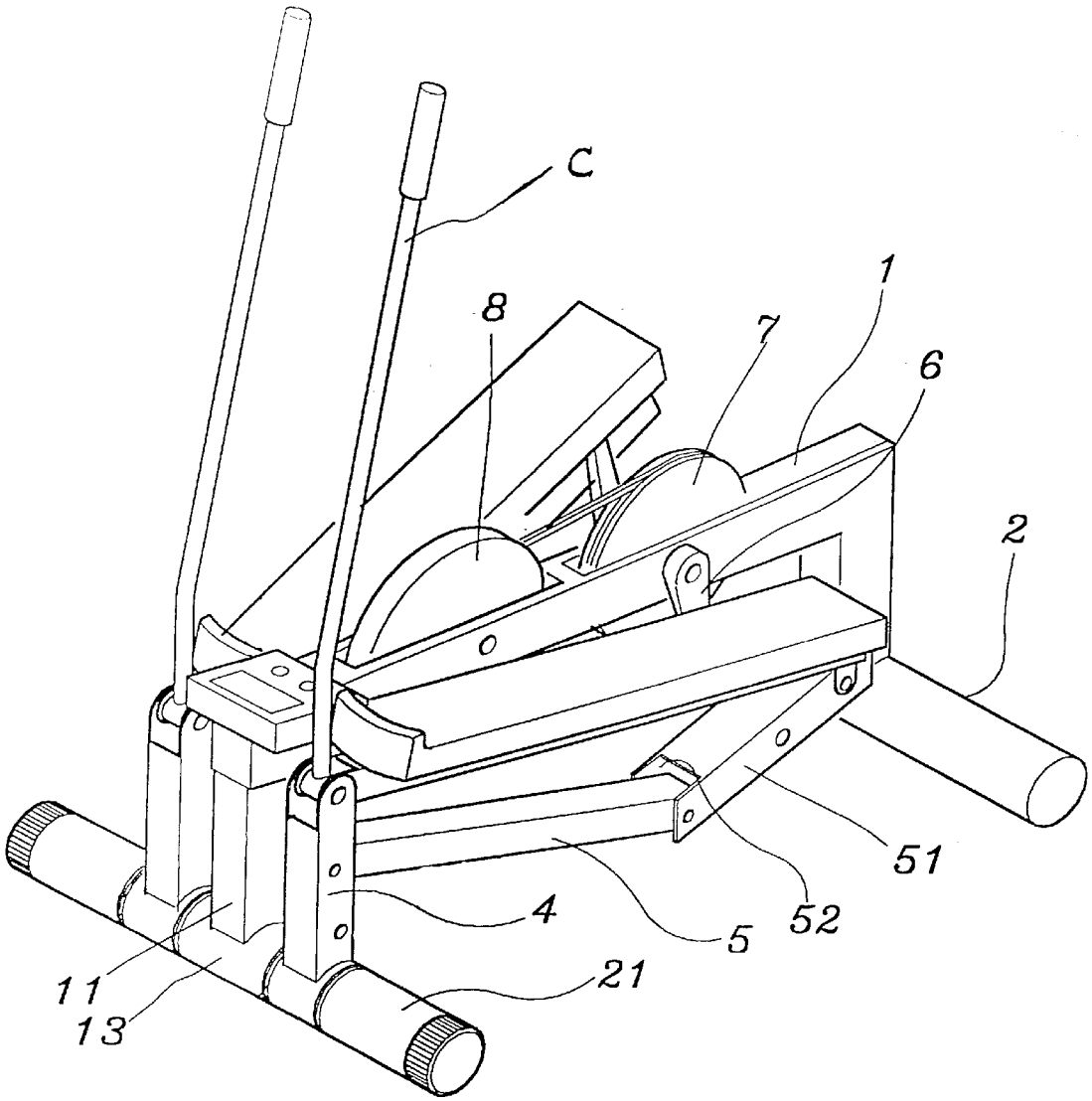
FIG.1B (PRIOR ART)
FIG. 1B is a perspective view of the exercising apparatus shown in FIG. 1A.
Figure 2:
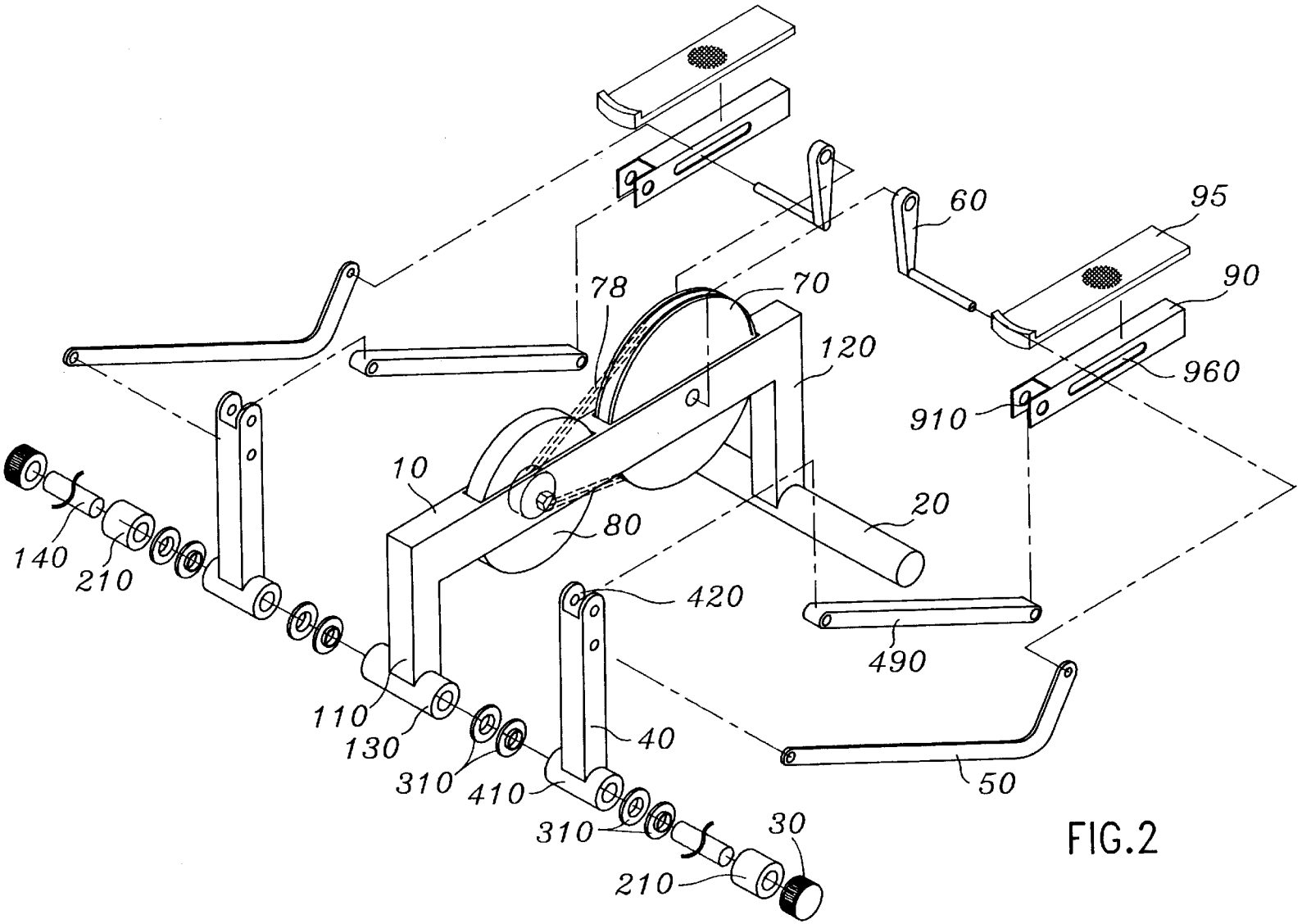
FIG. 2 is an exploded view of a walking exerciser according to a first embodiment of the present invention (the handlebars excluded).
Figure 3:
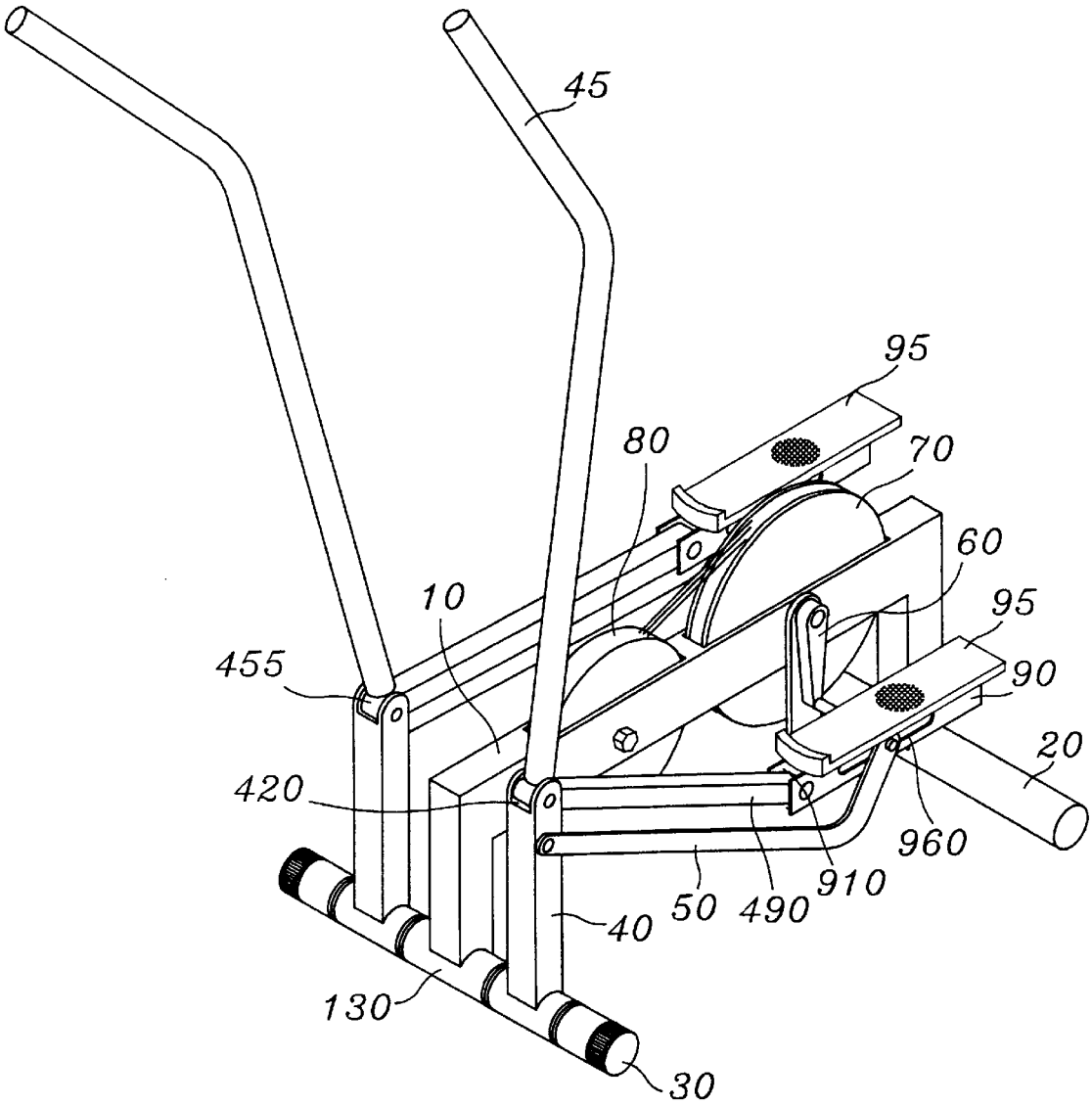
FIG. 3 is a perspective view of the walking exerciser shown in FIG. 2.

Referring to FIGS. 2 and 3, a walking exerciser in accordance with a first embodiment of the present invention comprises a base frame unit. The base frame unit comprises a front upright frame bar 110, a rear upright frame bar 120, a main shaft 10 horizontally connected between the top ends of the front upright frame bar 10 and the rear upright frame bar 120, a cross bar 20 connected to the bottom end of the rear upright frame bar 120 and adapted for supporting the climber on the floor, and a transverse barrel 130 connected to the bottom end of the front upright frame bar 110 and disposed in parallel to the cross bar 20. Two rockers 40 are respectively pivoted to two opposite ends of the transverse barrel 130. Each rocker 40 has a bottom end terminating in an axle housing 410, and a top end terminating in a pair of lugs 420. Two end tubes 210 are respectively pivoted to the axle housings 410 of the rockers 40 at an outer side by a respective pivot shaft 140. Two end caps 30 are respectively fastened to the end tubes 210 at an outer side. Friction members 310 are respectively mounted around the pivot shaft 140, and retained between the two opposite ends of the axle housings 410 of the rockers 40, the transverse barrel 130 and the end tubes 210. Two links 490 are provided having a respective front end respectively pivoted to the lugs 420 of the rockers 40, and a respective rear end respectively pivoted to front lugs 910 of a respective pedal frame 90. A foot plate 95 is fixedly mounted on each pedal frame 90 at the top. Each pedal frame 90 comprises a longitudinal sliding slot 960. A driving wheel 70 is revolvably supported on the main shaft 10. A flywheel 80 is revolvably supported on the main shaft 10, and coupled to the driving wheel 70 by a transmission belt 78. Two cranks 60 are respectively connected to driving wheel 70 at two opposite sides. The cranks 60 have a respective opposite end respectively inserted through the longitudinal sliding slots 960 on the pedal frame 90 and pivoted to a respective curved coupling rod 50. Each curved coupling rod 50 has a rear end coupled to one end of one crank 60 and moved with it along the longitudinal sliding slot 960 on one pedal frame 90, and a front end pivoted to one rocker 40 below its lugs 420.

When the user steps on the foot plates 95, the cranks 60 are alternatively turned. Because the curved coupling rods 50 are respectively pivoted to the cranks 60 and moved with the cranks 60 along the longitudinal sliding slots 960 on the pedal frames 90, the foot plates 95 are forced to rotate along a oval track.

Further, two handlebars 45 are provided having a respective bottom end terminating in a bearing 455 respectively pivoted to the lugs 420 of the rockers 40.

Figure 4A:
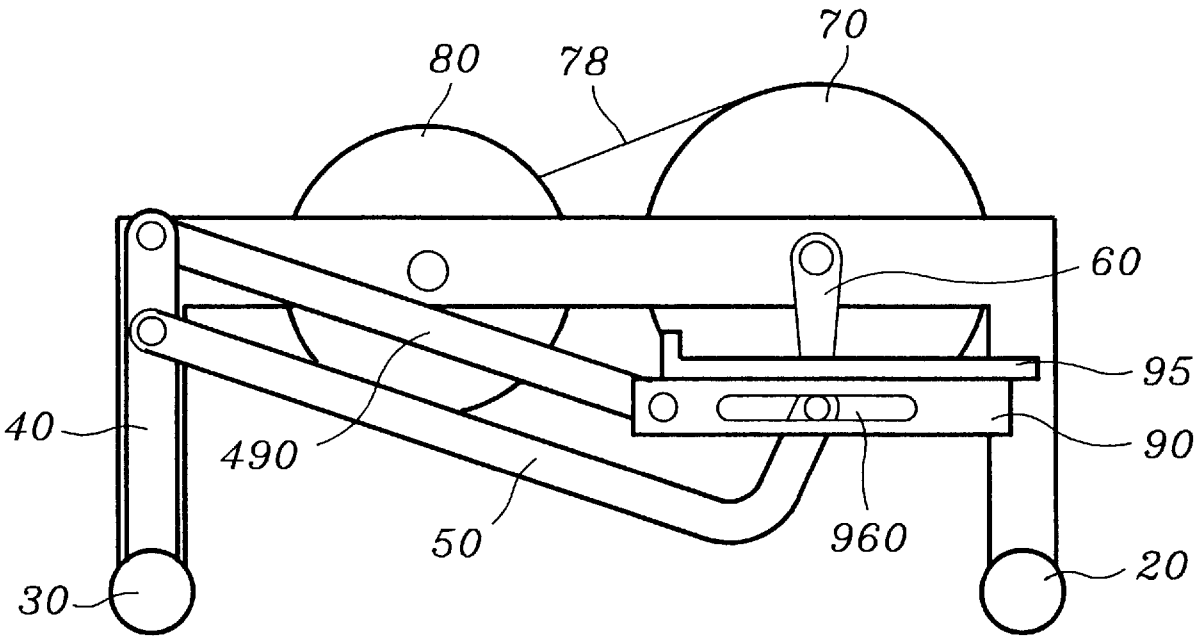
FIG. 4A is a side view of the first embodiment of the present invention, showing the crank moved to the lower limit position.
Figure 4B:
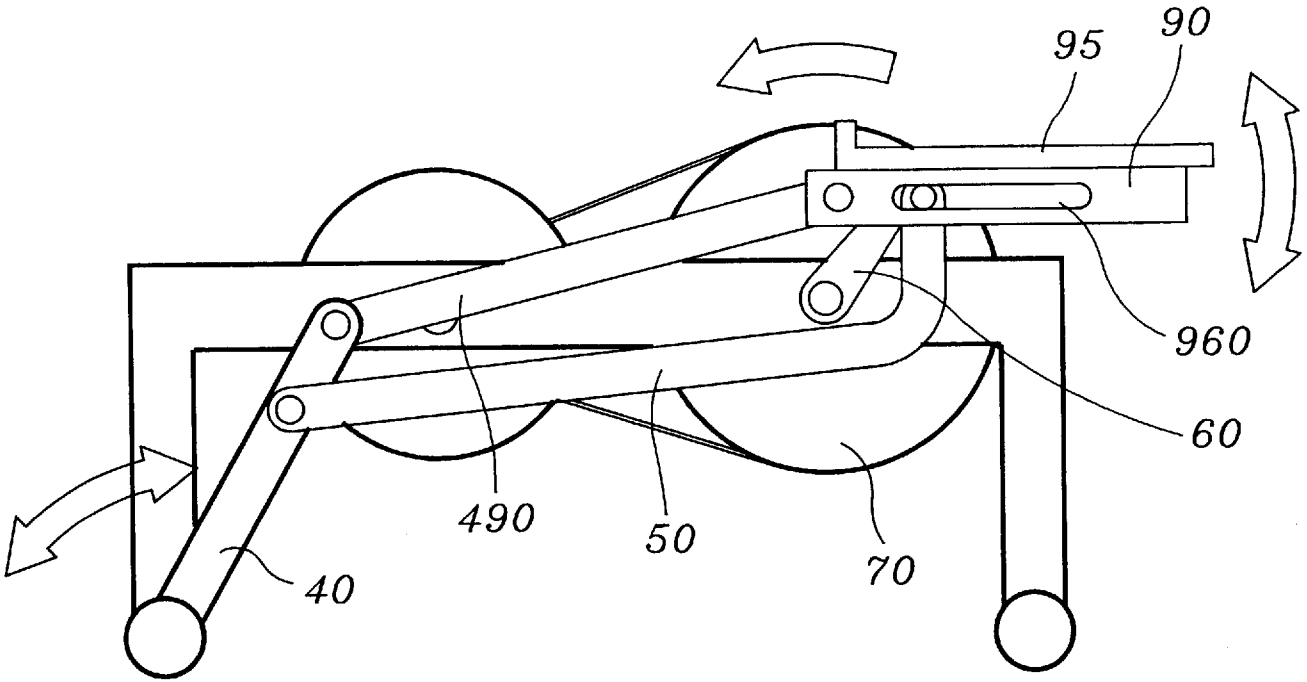
FIG. 4B is similar to FIG. 4A but showing the up stroke of the crank.
Figure 4C:
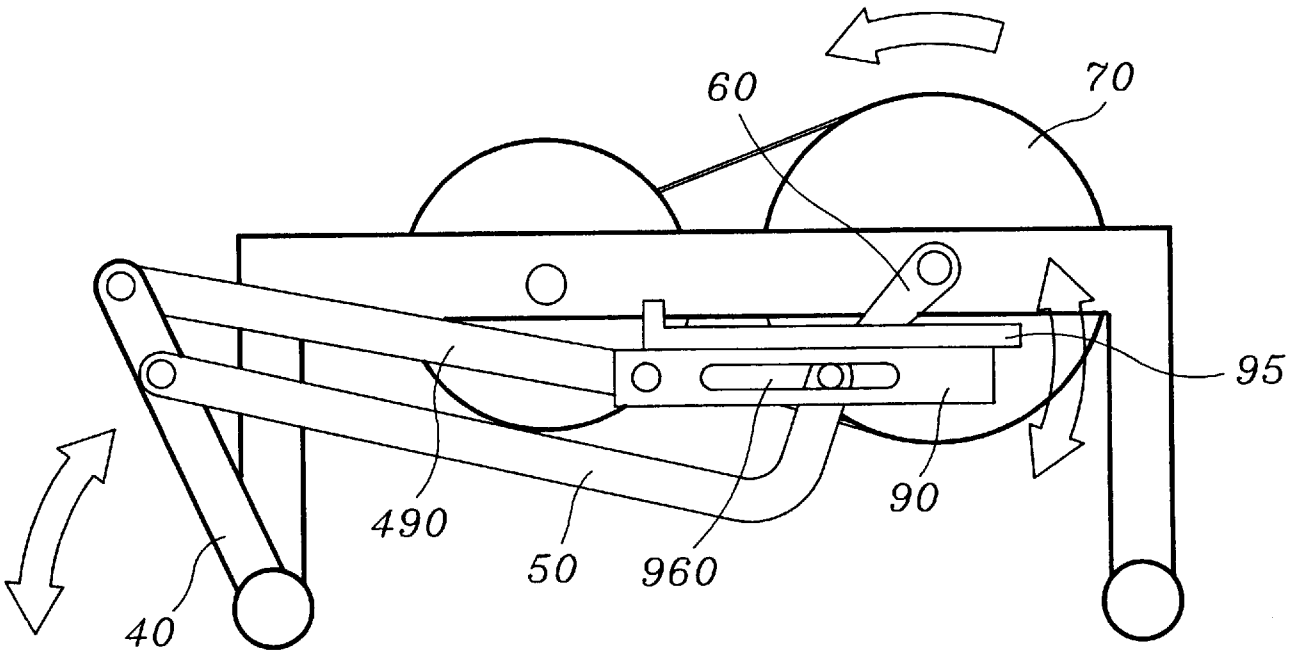
FIG. 4C is similar to FIG. 4A but showing the down stroke of the crank.

Referring to FIGS. from 4A to 4C, when the crank 60 is turned to the lower limit, the corresponding rocker 40 to moved to a vertical position, and the rear end of the corresponding curved coupling rod 50 is shifted to the middle point in the longitudinal sliding slot 960 on the corresponding pedal frame 90 (see FIG. 4A); during the up stroke of the crank 60, the rear end of the corresponding curved coupling rod 50 is shifted to the front end of the longitudinal sliding slot 960 on the corresponding pedal frame 90, and the corresponding rocker 40 is titled backwards (see FIG. 4B); during the down stroke of the crank 60, the rear end of the corresponding curved coupling rod 50 is shifted to the rear end of the longitudinal sliding slot 960 on the corresponding pedal frame 90, and the corresponding rocker 40 is tilted forwards (see FIG. 4C).

Figure 5:
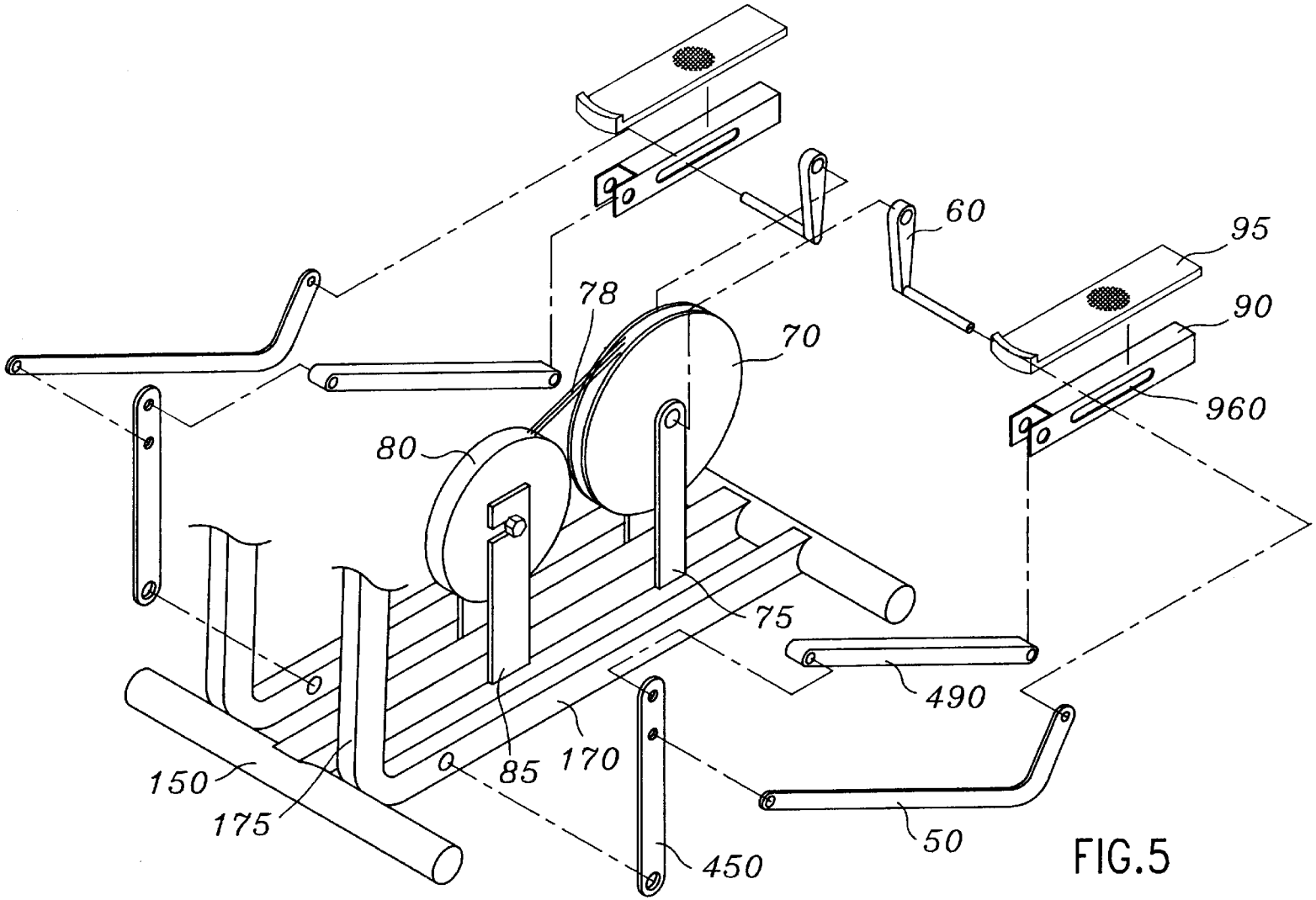
FIG. 5 is an exploded view of a walking exerciser according to a second embodiment of the present invention (handlebars excluded).
Figure 6:
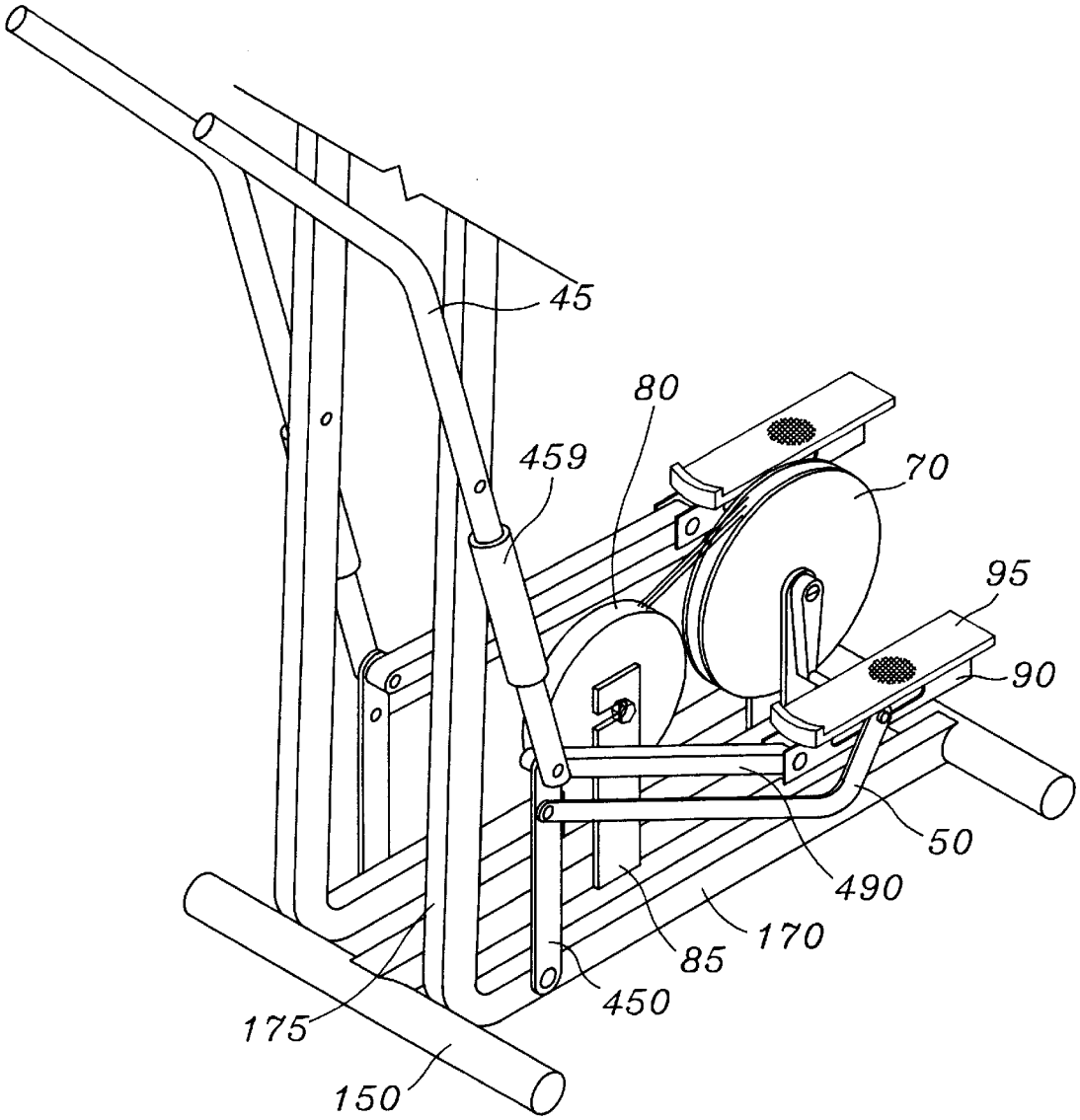
FIG. 6 is a perspective view of the walking exerciser according to the second embodiment of the present invention.

FIGS. 5 and 6 show a walking exerciser according to a second embodiment of the present invention. According to this embodiment, the walking exerciser comprises a substantially I-shaped base frame 150, two bottom frame bars 170 connected in parallel between two opposite ends of the I-shaped base frame 150, two upright frame bars 175 respectively integral with the front ends of the bottom frame bars 170, two rockers 450 having a respective bottom end respectively pivoted to the bottom frame bars 170 near the upright frame bars 175, two links 490 having a respective front end respectively pivoted to top ends of the rockers 450, two pedal frames 90 respectively pivoted to the rear ends of the links 490 remote from the rockers 450, each pedal frame 90 having a longitudinal sliding slot 960, two foot plates 95 respectively mounted on the pedal frames 90, a first wheel holder frame 75 raised from the I-shaped base frame 150 near its rear end, a second wheel holder frame 85 raised from the I-shaped base frame 150 in front of the first wheel holder frame 75, a driving wheel 70 revolvably supported on the first wheel holder frame 75, a flywheel 80 revolvably supported on the second wheel holder frame 85 and coupled to the driving wheel 70 by a transmission belt 78, two cranks 60 respectively connected to the driving wheel 70 at two opposite sides, two curved coupling rods 50 having a respective front end respectively pivoted to the rockers 450 below the links 490 and a respective rear end respectively pivoted to the cranks 60 and moved with the cranks 60 along the longitudinal sliding slots 960 on the pedal frame 90, and two handlebars 450 respectively pivoted to the upright frame bars 175, two coupling tubes 459 having a respective bottom end respectively pivoted to the top ends of the rockers 450 and the front ends of the links 490 and a respective top end respectively coupled to the bottom ends of the handlebars 450 by a sleeve joint. The operation of the walking exerciser according to the second embodiment is similar to the walking exerciser according to the first embodiment of the present invention.

Accordingly, this present invention provides an improved structure of walking exerciser. The structure of this present invention is simplifier, easier to manufacture, and the foot plates are retained horizontally during the exercises.

The above disclosure is not intended as limiting. Those shilled in the art will readily observe that numerous modifications and alterations of the device may be made while retaining the tachings og the invention. Accordingly, the above disclosure should be construed as limiting only by the mates and bounds of the appended claims.

It is to be understood that the drawings are designed for purposes of illustration only, and are not intended as a definition of the limits and scope of the invention disclosed.

What the invention claimed is:

1. A walking exerciser comprising:

a base frame unit comprising a front upright frame bar having a bottom end and a top end, a rear upright frame bar having a bottom end and a top end, a main shaft horizontally connected between the top ends of said front upright frame bar and said rear upright frame bar, a cross bar connected to the bottom end of said rear upright frame bar, and a transverse barrel connected to the bottom end of said front upright frame bar and disposed in parallel to said cross bar;

a driving wheel revolvably supported on said main shaft;

a flywheel revolvably supported on said main shaft and coupled to said driving wheel by a transmission belt;

two cranks having a respective first end respectively connected to said driving wheel and a respective second end, said cranks being driven to rotate said driving wheel;

two rockers having a respective bottom end respectively pivoted to two opposite ends of said transverse barrel, and a respective top end;

two pedal frames respectively supported on the second ends of said cranks, said pedal frames having a respective front end respectively coupled to said rockers, and a respective longitudinal slinging slot which receives the second end of the corresponding crank; and two curved coupling rods having a respective front end respectively pivoted to the top end of said rockers and a respective rear end respectively pivoted to the second ends of said cranks and moved with said cranks along the longitudinal sliding slots on said pedal frames.

2. The walking exerciser of claim 1 further comprising two links having a respective front end respectively pivoted to the top ends of said rockers, and a respective rear end respectively pivoted to the front ends of said pedal frames.

3. The walking exerciser of claim 1 further comprising two foot plates respectively and fixedly mounted on said pedal frames.

4. The walking exerciser of claim 1 further comprising two handlebars respectively pivoted to the top ends of said rockers.

5. The walking exerciser of claim 4, wherein said handlebars have a respective bottom end respectively terminating in a bear respectively pivoted to the top ends of said rockers.

6. A walking exerciser comprising:

a substantially I-shaped base frame;

two bottom frame bars connected in parallel between two opposite ends of said I-shaped base frame;

two rockers having a respective bottom end respectively pivoted to said bottom frame bars, and a respective top end;

a first wheel holder frame raised from said I-shaped base frame;

a second wheel holder frame raised from said I-shaped base frame in front of said first wheel holder frame;

a driving wheel revolvably supported on said first wheel holder frame;

a flywheel revolvably supported on said second wheel holder frame and coupled to said driving wheel by a transmission belt;

two cranks having a respective first end respectively connected to said driving wheel at two opposite sides, and a respective second end;

two pedal frames respectively supported on the second ends of said cranks, said pedal frames having a respective longitudinal sliding slot; and two curved coupling rods having a respective front end respectively pivoted to the top ends of said rockers, and a respective rear end respectively pivoted to the second ends of said cranks and moved with said cranks along the longitudinal sliding slots on said pedal frame.

7. The walking exerciser of claim 6 further comprising two links having a respective front end respectively pivoted to the top ends of said rockers, and a respective rear end respectively pivoted to said pedal frames.

8. The walking exerciser of claim 6 further comprising two foot plates respectively and fixedly mounted on said pedal frames.

9. The walking exerciser of claim 6 further comprising two handlebars respectively coupled to the top ends of said rockers.

10. The walking exerciser of claim 9 further comprising two coupling tubes coupled between said handlebars and said rockers, said coupling tubes having a respective bottom end respectively pivoted to the top ends of said rockers and a respective top end respectively sleeved onto said handlebars at one end.

11. The walking exerciser of claim 9 further comprising two upright frame bars respectively integral with front ends of said bottom frame bars for supporting said handlebars.

12. The walking exerciser of claim 11, wherein said handlebars are respectively pivoted to said upright frame bars.

* * * * *